United States Patent [19]

Lombardi et al.

[11] 3,968,580

[45] July 13, 1976

[54] BUCKET WHEEL ASSEMBLY

[75] Inventors: Raymond P. Lombardi, Pittsburgh; Thomas D. Wertz, Coraopolis; Ira W. Lakin, Volant, all of Pa.

[73] Assignee: Dravo Corporation, Pittsburgh, Pa.

[22] Filed: Mar. 17, 1975

[21] Appl. No.: 559,217

[52] U.S. Cl. ..... 37/189; 37/94

[51] Int. Cl.[2] ..... E02F 3/24

[58] Field of Search ..... 37/189, 190, 94–97, 37/70, DIG. 2, DIG. 17, 119

[56] References Cited

UNITED STATES PATENTS

| | | | |
|---|---|---|---|
| 3,020,656 | 2/1962 | Linden | 37/190 B |

FOREIGN PATENTS OR APPLICATIONS

| | | | |
|---|---|---|---|
| 1,012,265 | 7/1957 | Germany | 37/190 B |
| 723,000 | 7/1942 | Germany | 37/189 B |
| 763,672 | 3/1954 | Germany | 37/189 B |
| 711,240 | 9/1941 | Germany | 37/189 B |
| 1,029,751 | 5/1958 | Germany | 37/190 B |
| 1,073,402 | 1/1960 | Germany | 37/190 B |

*Primary Examiner*—E. H. Eickholt

*Attorney, Agent, or Firm*—Parmelee, Miller, Welsh & Kratz

[57] ABSTRACT

A compartmented bucket wheel assembly in which the compartments extend radially inward and angularly opposite the direction of wheel rotation to facilitate emptying of the compartments and thereby increase the capacity of the bucket wheel. In a structurally simple but sturdy preferred form, the buckets are mounted between the extremities of a plurality of plate members, the outer portions of which extend diagonally outward in the direction of wheel rotation at an obtuse angle to the radially directed inner portions thereof. A number of flat, generally triangular plates disposed between the outer portions of adjacent plate members deflect the material toward the discharge edge which extends diagonally inward from the periphery of the wheel adjacent the front of the bucket along one lateral edge of the outer portion of the leading plate member associated with a particular bucket, to the intersection of the inner and outer portions of the associated trailing plate member.

12 Claims, 4 Drawing Figures

BUCKET WHEEL ASSEMBLY

BACKGROUND OF THE INVENTION

1. Field of the Invention

This invention relates to bucket wheels for handling bulk materials and more particularly, it relates to compartmented bucket wheels.

2. Prior Art:

In compartmented bucket wheels a plurality of buckets, mounted on the periphery of a drum rotated about a horizontal axis, scoop up material which slides radially inward into compartments within the drum as the bucket travels upward. Diagonal deflection surfaces within the compartments direct the material laterally out of the drum onto a conveyor or other suitable receiving device as the bucket approaches the top of the arc.

Whether the drum is cylindrical or in the shape of a regular polygon in vertical section, and whether separate compartments are provided for each bucket or for a group of buckets, the walls separating the compartments generally converge in the radially inward direction. Thus a funneling effect is produced as the material slides downward and laterally out of the drum. Even in U.S. Pat. No. 992,346 wherein the walls of the compartments are not radially oriented, the material is funneled down to a small lateral opening.

This funneling effect is a limiting factor in the capacity of the prior art bucket wheels. Sufficient time must be allowed for the material to slide out of the compartments which, in turn, limits the speed of rotation of a given bucket wheel. This becomes even more of a problem when the material being handled does not have free-flowing characteristics.

U.S. Pat. No. 3,020,656 suggests that the front walls of the compartments diverge laterally to assist in discharging material, however, the compartments still converge in the radial direction which porduces the funneling effect. As in the other prior art bucket wheels, the front corner of the compartment drops below the level of the chute directing material to the receiving conveyor before all of the material has been discharged, thus resulting in the trapping of a certain amount of material and wasteful carryover.

SUMMARY OF THE INVENTION

In accordance with the invention, a compartmented bucket wheel assembly comprises a shell structure mounted for rotation about a substantially horizontal axis. A plurality of buckets are angularly displaced about the periphery of the shell for scooping up material as the shell is rotated. Partitions disposed and arranged within the shell structure form compartments for the buckets, which are at least partially open at the periphery to receive material from the associated bucket and which extend diagonally inward and in the direction opposite the direction of shell rotation from the periphery of the shell to trail diagonally behind the buckets. The compartments are provided with deflecting surfaces which slope radially inward and angularly in the direction of shell rotation, from one lateral face of the shell toward a discharge edge of extended length in the opposite lateral face of the shell. Preferably a separate compartment is provided for each bucket.

The rear of trailing wall of each compartment, which substantially supports the material while the bucket is being raised by shell rotation, extends from the periphery of the shell adjacent the rear of the associated bucket diagonally inward and in the direction opposite the direction of rotation. Thus the rear wall becomes inclined to the horizontal to the point that the material supported thereby is dislodged at a high flow rate earlier in the upward travel of the bucket than a corresponding radially oriented rear wall.

The partition which forms the front wall of each compartment slopes in the direction of shell rotation from one lateral face to the other of the shell and, at the same time, slopes diagonally in the direction opposite the direction of shell rotation from the periphery of the shell inward. This permits the compartment to continue dumping material well past the peak of the arcuate travel of the buckets whereas in the conventional radial walled compartments, radial movement of the material is necessary to empty the compartment and this is reduced significantly shortly after top dead center of bucket travel. A bucket wheel constructed according to the teachings of this invention, therefore, dumps material at a high flow rate over a greater portion of the arcuate travel of the bucket, which permits the bucket wheel to be operated more efficiently and, therefore, increases the capacity of a given bucket wheel. It is especially useful for materials which are not free flowing.

In a preferred form of the invention, the shell structure includes a hub from which a plurality of plate members, bolted longitudinally to the hub, extend outward at equally spaced intervals. The plate members are bent along a line parallel to the axis of the hubs with the inner portions of the plate members extending radially outward from the hub and the outer portions extending obliquely outward from the inner portions in the direction of shell rotation. The buckets are mounted between the outer extremities of the plate members. The trailing compartments are formed by partitions placed between the outer portions of the plate members. Preferably, these partitions are flat, triangular plates which facilitates fabrication of the bucket wheel.

DESCRIPTION OF THE PREFERRED EMBODIMENT

Figure 4:
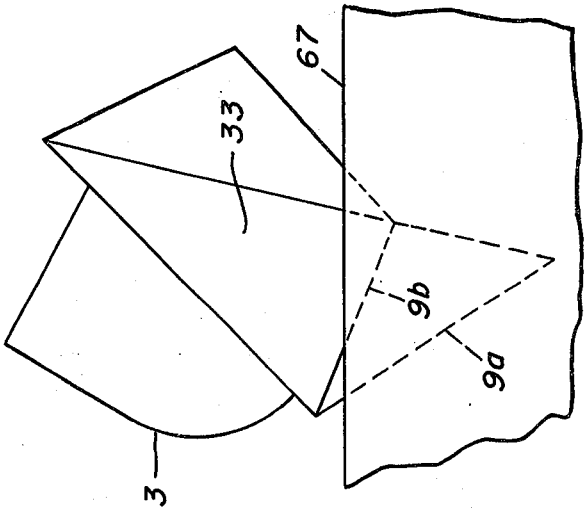
FIG. 4 is a schematic diagram comparing the present bucket compartment with the conventional prior art radial walled bucket compartment.

Referring to the drawings, a bucket wheel 1, constructed in accordance with the principles of the invention, includes a plurality of buckets 3 mounted on the periphery of a shell structure 5. The shell structure may be in the shape of a regular polygon, such as the octagon shown, with the buckets mounted on each peripheral face thereof. The shell structure 5 includes an elongated hub 7 to which eight plate members 9, in the instance of an octagonal shell, are longitudinally bolted at equally spaced intervals about the circumference of the hub. Each of the plate members 9 is bent along a bend line 11 parallel to the axis of the hub 7. The inner portions of the plate members extend radially from the hub 7 while the outer portions project outward in the direction of wheel rotation, preferably at an obtuse angle $\alpha$ to the respective inner portions. One edge of the inner portion of each plate member 9 is recessed, leaving a lip 13 the purpose of which will be discussed below.

Welded to the recessed edges of the inner portions of the plate members 9 is an octagonal plate 15. A second larger octagonal plate 17 is welded to both the inner and outer portions of the opposite edges of the plate members. Brace members 19 are secured between the outer extremities of the first edges of the plate members to complete the shell structure which is structurally rigid yet simple in design. Openings 21 may be cut in the inner portions of the plate members 9 to remove weight from the shell structure without any significant effect on its structural integrity.

The buckets 3 are mounted on the periphery of the shell with the open digging or leading end facing in the same angular direction as the outwardly projecting outer portions of the plate members 9. Each bucket is secured in place in any suitable manner, such as by a pin 23 projecting from each side of the bucket (only one shown) and by lugs 25 (see FIG. 1) projecting from the rear or trailing end of the bucket on each side. The pins 23 are engaged by slotted plates 27 welded to approximately the center of the brace 19 and the opposing peripheral edge of the octagonal plate 17. The lugs 25 on the rear of the bucket are bolted to bosses 29 mounted on the shell adjacent the ends of a cross member 31 welded between the brace 19 and the plate 17 at the outer extremity of each plate member 9. With this arrangement, the bucket may be quickly and easily changed with minimum down time.

Figure 2:
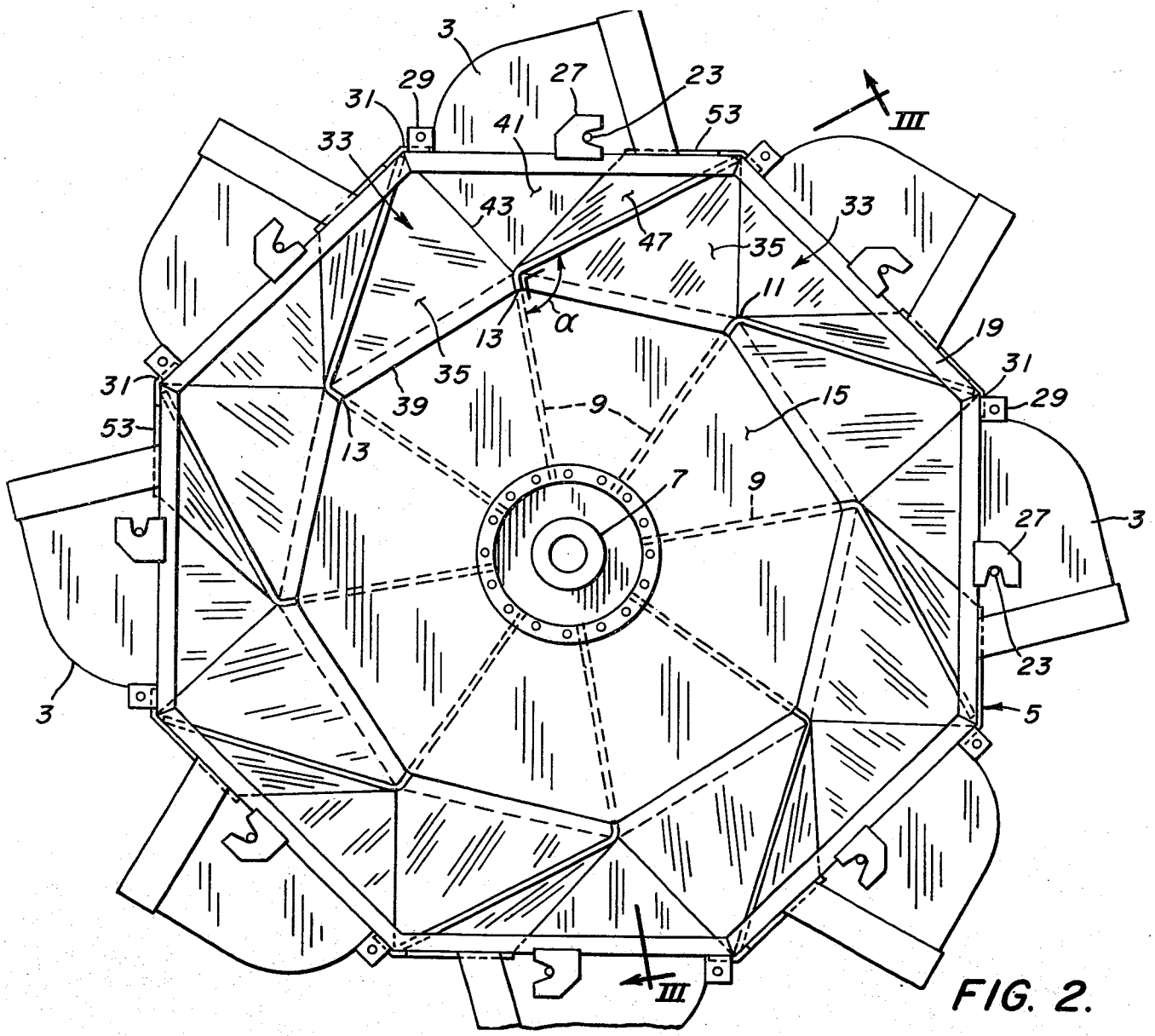
FIG. 2 is an elevation view of the bucket wheel illustrated in FIG. 1.

Associated with each bucket is a compartment 33 formed in the shell 5 between the outer portions of the adjacent plate members 9. As seen best in FIG. 2, these adjacent outer portions of the plate members 9 serve as partitions which extend diagonally inward and in the direction opposite and the direction of wheel rotation from the vertices of the face of the polygonal shell such that the compartment 33 trails behind the associated bucket. A number of generally triangular plates or partitions are interposed between the outer portions of the plate members 9 to deflect material laterally out of the associated compartment.

Figure 1:
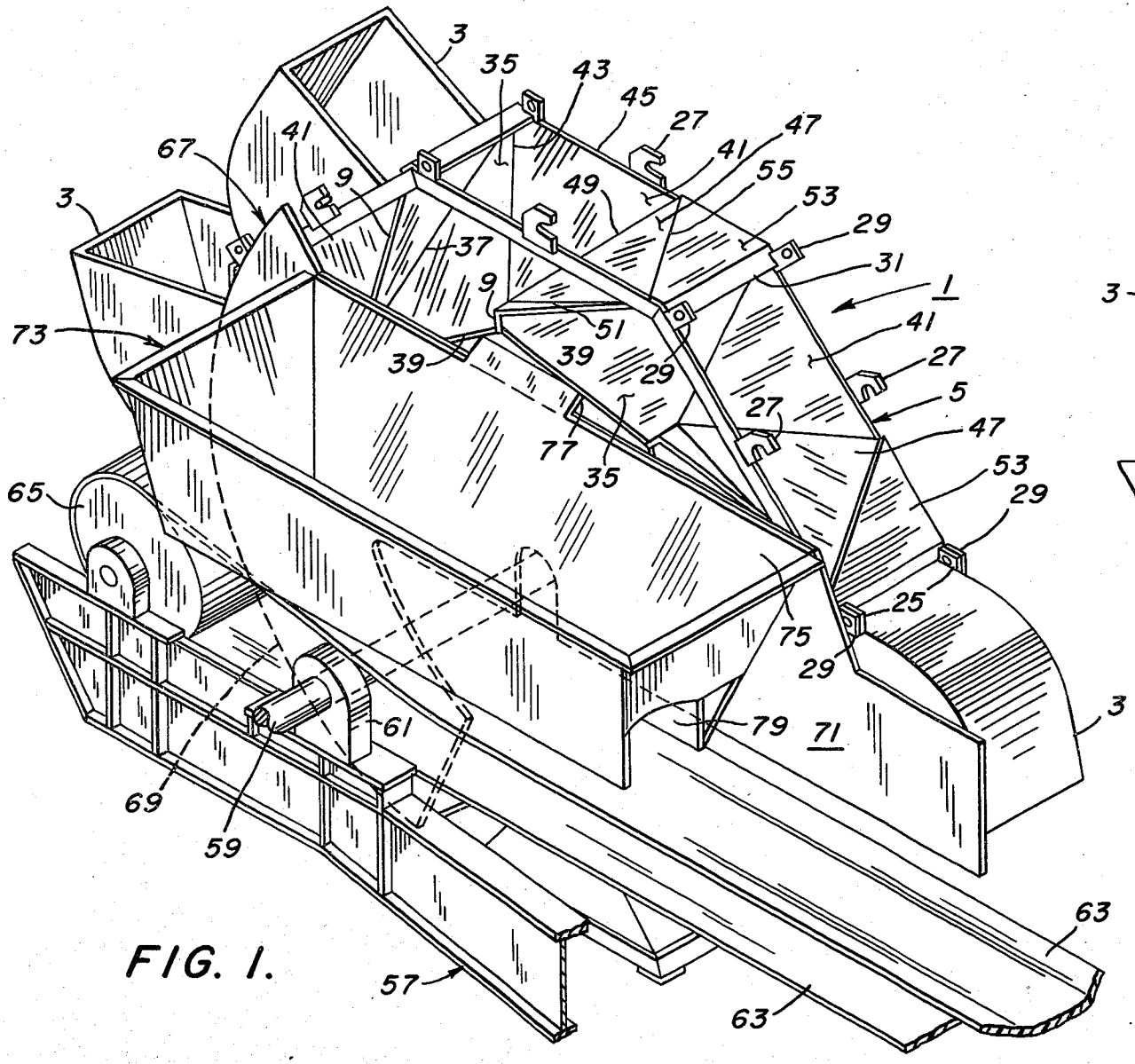
FIG. 1 is an isometric view of a bucket wheel assembly incorporating the present invention, with some parts removed for clarity, mounted on the end of boom.

The arrangement of these generally triangular plates can be best be appreciated from the isometric view of FIG. 1. A first generally triangular plate 35 has a first edge 37 which abuts the outer portion of the trailing plate member 9 forming the compartment, and extends diagonally from the upper rear corner of the compartment radially inward and laterally outward to the lip 13 (see FIG. 2) in that plate member at the front lateral face of the shell 5. A second edge 39 of the plate 35 extends from that point to the lip 13 on the leading plate member 9 associated with the compartment. A second generally triangular plate 41 has a first edge 43 which is coextensive with the remaining edge of the generally triangular plate 35 and a second edge 45 which extends from the outer rear corner of the compartment along a portion of the rear edge of the associated peripheral face of the polygonal shell. A third triangular plate 47 has a first edge 49 coextensive with the third side of the plate 41 and a second side 51 which extends substantially along the front edge (as viewed in FIGS. 1 and 2) of the outer portion of the leading plate member 9. These edges do not exactly coincide in the configuration shown since the plate 35 is sloped to intersect the lips 13 on the plate member 9 which, in turn, shifts the position of the plate 41 and correspondingly the plate 47.

Henceforth, the edge 39 of plate 35 and the combined edge formed by the edge 51 of plate 47 and the edge of the outer portion of the leading plate member 9 will be referred to as the discharge edge. Inspection of the drawings shows that the plates 35 and 41 slope laterally and radially inward toward the inner portion of the discharge edge while the plate 47, which forms the front wall of the compartment, slopes laterally generally in the direction of wheel rotation toward the outer portion of the discharge edge and at the same time slopes angularly back from the periphery of the shell 5 in the direction opposite the direction of wheel rotation.

Figure 3:
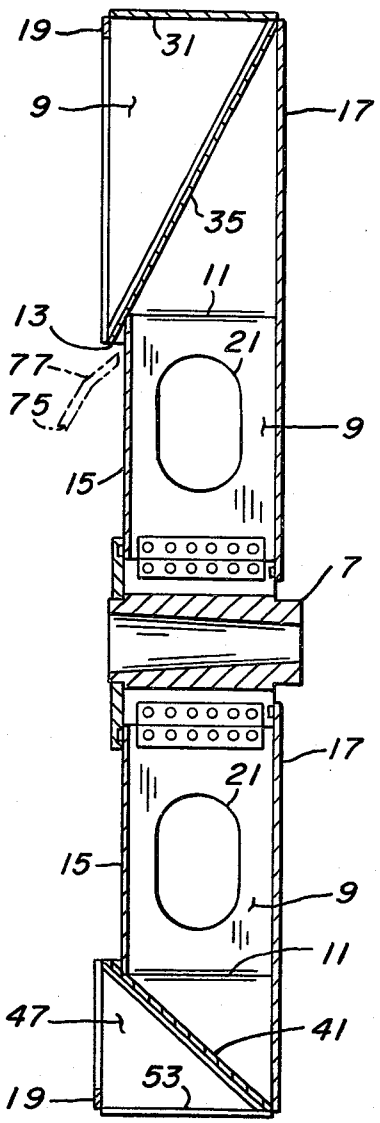
FIG. 3 is an irregular sectional view of the bucket wheel taken along the line III—III in FIG. 2.

A fourth plate 53 caps off the forward end of the peripheral face of the polygonal shelf between the remaining edge 55 of the plate 47, the peripheral edge of the plate 17 and the cross member 31. The portion of the peripheral face of the polygon bounded by the brace 19, the cross member 31, the edge 45 of plate 41 and the edge 55 of plate 53 is open to receive material from the bucket. The portion of the lateral face of the shell seen in FIGS. 1 and 2 bounded by the side edge of the outer portion of the trailing plate member 9, the discharge edge and the brace 19 is open to discharge material from the compartment. The plates 35, 41, 47 and the portion of the trailing plate member 9 forming the rear walls of the compartments 33 may be covered with wear plates as illustrated for the compartment shown at the 12 o'clock position in FIGS. 2 and 3.

As illustrated in FIG. 1, the bucket wheel 1 may be mounted on the end of the boom 57 of a stacker-reclaimer or other material handling machine. As is conventional in this type of equipment, the bucket wheel is mounted on the side of the boom with the bucket wheel shaft 59 supported by a pair of bearings 61 (only one of which is shown) on either side of the boom 57. The shaft 59 may also be tipped toward the boom as is known in the prior art, but even in that instance it can be considered to be substantially horizontal. The bucket wheel is rotated in the clockwise direction, as viewed in FIG. 1, by an electric or hydraulic motor through a gear reducer (neither of which are shown) mountd on the near side of the boom. A coneyor belt 63, which extends along the boom 57, passes around a return pulley 65 with the upper work run and lower return run of the conveyor belt straddling the bucket wheel shaft 59. A retainer plate 67 mounted vertically (supports not shown) to the side of the boom has a depending arcuate section 69 which covers the lateral openings in the bucket compartments 33 to retain material scooped up by the buckets in the compartments until they are above the work run of the conveyor 63. The retainer plate 67 also has a horizontal section 71 which extends along the conveyor for substantially the full width of the bucket wheel.

A chute 73 is mounted on the boom (supports not shown) over the conveyor belt to guide material discharged from the compartments in the bucket wheel onto the conveyor. To this end, the inner longitudinal wall 75 of the chute is inclined toward the bucket wheel and rests on the top edge of the horizontal portion 71 of the retainer plate. A lip 77 on the upper edge of the chute wall 75 extends into the recess in the lateral face of the bucket wheel under the compartment discharge edges to minimize loss of material in this area. The inner end of the chute 73 is provided with an opening 79 through which the material deposited on the conveyor passes. The chute 73 can be pivotally mounted so that it may be swung clear of the conveyor to permit material deposited on the inner end of the conveyor (not shown) to be carried outward and dropped off the end of the boom when the equipment is being used as a stacker. The bucket wheel 1 is not used in this operation.

The advantages of this improved bucket wheel can best be appreciated from a description of its operation. The material scooped up by the buckets in the lower forward portion of their arcuate travel, slides into the compartments 33 as the buckets are raised. The material is supported in the compartments as upward travel continues mainly by the rear wall formed by the outer portion of the associated trailing plate member 9. The material remains in this position until the rear wall is tilted enough with respect to the horizontal to cause the material to slide toward the laterally sloping deflecting surfaces 35, 41 and 47, which then direct the material out of the compartments onto the chute 73 as the compartment is raised above the upper edge of the fixed retainer plate 67. It can be appreciated from FIG. 4 that the diagonally trailing rear wall 9a of the disclosed bucket wheel has reached this critical angle of inclination by the time it appears above the top edge of the retainer plate 67 while the conventional radial trailing wall of prior art compartmentns **9*b*** still has only a slight angle to the horizontal at this point. Thus the present bucket wheel begins dumping material at a high flow rate as soon as the compartment is above th top edge of the retainer plate and, therefore, the chute while the radial-walled bucket wheels do not begin heavy dumping until the compartment approaches the top of the arc.

In addition, raking back the leading edge of the compartment and sloping the deflecting surfaces toward that edge provides a discharge edge of extended length and one which remains above the discharge chute for more arcuate travel of the wheel. This is in contrast to the prior art bucket wheels in which the pocket formed by the radial front wall and the bottom wall of the compartment disappeared below the top edge of the chute soon after top dead center of the wheel, resulting in excessive carry over of trapped material. It can also be appreciated that since the compartment discharge edge is much longer than the peripheral opening through which material is received from the bucket in the present bucket wheel, the opposite of the funneling effect produced by the radially converging compartments of the prior art is achieved here and aids in emptying the compartments. Thus bucket wheels constructed according to the present invention begin dumping material at a high flow rate sooner in the arcuate travel of the buckets and continue this high flow rate for a longer portion of that arc than prior art bucket wheels. This arrangement improves the efficiency of the bucket wheel and, therefore, increases the capacity of a given size wheel. It is particularly suitable for materials which are not free flowing and have a tendency to stick such as some ores, especially when wet. It is also particularly suitable for machines, such as that illustrated, in which the work run of the receiving conveyor is located above the bucket wheel shaft.

While a preferred form of the invention has been illustrated, it will be understood by those skilled in the art that various modifications and changes may be made therein. For instance, the shell 5 could be made cylindrical rather than polygonal and the plates 35 and 41 could be replaced by a conical surface. In addition, the outer portions of the plates 9 could be eliminated such that the plates 47 forming the forward wall of each compartment would also form the rear wall of the preceding compartment. Other modifications also within the broad principles of the invention could be made to the assembly. Various aspects of the invention are set forth in the following claims.

What is claimed is:

1. A compartmented bucket wheel assembly comprising:

a. a shell structure mounted for rotation about a substantially horizontal shaft and having two axially displaced lateral faces;

b. a plurality of buckets angularly displaced about the periphery of the shell structure for scooping up material as the shell is rotated; and c. partitions within said shell structure disposed and arranged to define compartments for the buckets which are at least partially open toward the periphery of the shell to receive material from the buckets and which compartment extend diagonally inward and in the direction opposite the direction of shell rotation from the periphery of the shell to trail diagonally behind the buckets, said compartments being provided with deflecting surfaces which slope radially inward and angularly in the direction of shell rotation from one lateral face of the shell toward a discharge edge of extended length in the second lateral face of the shell.

2. The bucket assembly of claim 1 wherein the buckets are spaced at equal intervals about the periphery of the shell and wherein said partitions define a separate compartment for each bucket.

3. The bucket assembly of claim 2 wherein said discharge edge extends substantially from the periphery of the shell ahead of the associated bucket diagonally inward and in the direction opposite the direction of shell rotation to a point radially closer to the axis of the shell and angularly displaced in the direction opposite the direction of shell rotation behind the intersection of the rear wall of the associated compartment and the periphery of the shell.

4. The assembly of claim 3 wherein the partition forming the rear wall of each compartment extends from the periphery of the shell adjacent the rear of the associated bucket diagonally inward and in the direction opposite the direction of shell rotation whereby the rear wall, which substantially supports the material while the bucket is being raised by shell rotation, becomes inclined to the horizontal to the point that material supported thereby is dislodged earlier in the upward travel of the bucket than a corresponding radially oriented rear wall.

5. The assembly of claim 4 wherein said partition forming the rear wall is substantially perpendicular to the lateral faces of the shell.

6. The assembly of claim 2 wherein the partition forming the front wall of the compartment provides a surface which slopes in the direction of shell rotation from said one lateral face of the shell to the second lateral face thereof, and which also slopes diagonally in the direction opposite the direction of shell rotation from the periphery of the shell inward.

7. The assembly of claim 6 wherein the partition forming the rear wall of each compartment extends from the periphery of the shell adjacent the rear of the associated bucket diagonally inward and in the direction opposite the direction of shell rotation and wherein the deflecting surface between the partitions forming the front and rear walls of each compartment slopes generally radially inward from said one lateral face of the shell and terminates in the second lateral face thereof along a line extending between the inner extremities of the intersections of the associated front and rear partitions with said second lateral face of the shell, said discharge edge of each compartment including this line and the intersection of the partition forming the front wall of the compartment and the second lateral face of the shell.

8. The assembly of claim 7 wherein the intersection of the partition forming the rear wall of each compartment with the second lateral face of the shell is substantially coextensive with the intersection of the partition forming the front wall of the trailing compartment with the second lateral face of the shell.

9. The assembly of claim 8 wherein the partition forming the rear wall of each compartment is substantially perpendicular to the lateral faces of the shell and wherein the deflecting surface between the partitions forming the front and rear walls of each compartment comprises a plurality of planar surfaces.

10. The assembly of claim 9 wherein said plurality of planar surfaces includes a first generally triangular flat plate having a first side which abuts the rear wall of the partition and extends diagonally along said rear wall from said one lateral face of the shell inward to the second lateral face thereof, and having a second edge which intersects the second lateral face of the shell along said line extending between the inner extremities of the intersection of the partitions forming the front and rear wall of the compartments with the second lateral face of the shell, and a second generally triangular flat plate having a first edge coextensive with the remaining edge of the first generally triangular flat plate and a second edge which extends along the first lateral face of the shell, said partition forming said front wall of the compartment comprising a third generally triangular flat plate having one edge thereof coextensive with the remaining edge of the second generally triangular flat plate.

11. A compartmented bucket wheel assembly comprising:

a. a shell structure including
   i. a hub mounted with a substantially horizontal axis, and
   ii. a plurality of plate members angularly distributed about the hub, with the planes thereof parallel to the axis of the hub, said plate members having inner portions extending radially outward from said hub and outer portions extending obliquely outward from each inner portion at the same obtuse angle thereto;

b. a plurality of buckets mounted on the periphery of the shell structure between the outer extremities of said plate members with the open leading edges of said buckets, which scoop up material as the shell is rotated, facing in the same angular direction as the outer portions of said plate members; and c. deflecting members mounted in the shell structure between adjacent plate members to form a compartment for each bucket for receiving material scooped up thereby, said deflecting members forming a deflecting surface which slopes from the periphery of the shell structure between the outer extremities of the plate members at one lateral edge thereof, generally inwardly and in the direction of wheel rotation to a discharge edge, a first portion of which is coextensive with the opposite lateral edge of the outer portion of the leading plate member associated with the particular bucket compartment and a second portion extending between the intersections of the inner and outer portions of said adjacent plate members at said opposite lateral edges thereof, whereby material scooped up by each bucket near the lower point of travel as the shell is rotated about the horizontal axis of the hub, slides downward into the associated compartment and is deflected by the deflecting surface laterally out of the same along both portions of said discharge edge as the buckets are raised.

12. The assembly of claim 11 wherein the deflecting members include:

a. a first generally triangular flat plate having a first side extending between the outer extremity of the associated trailing plate member at said one lateral edge thereof and the intersection of the first and second portions of said trailing plate member at the second lateral edge thereof, and having a second side coextensive with said second portion of the discharge edge;

b. a second generally triangular flat plate having a first side coextensive with the third side of said first flat plate and having a second side extending from the outer extremity of the trailing plate member at the first lateral edge thereof along a portion of a straight line joining the outer extremities of the associated plate member at the first lateral edges thereof;

c. a third generally triangular flat plate having a first side coextensive with the third side of the second flat plate and having a second side coextensive with the first portion of the discharge edge; and d. a fourth generally triangular flat plate having a first side coextensive with the third side of the first flat plate and a second side extending along the remaining portion of the line joining the outer extremities of the associated plate members at the first lateral edges thereof.

* * * * *